US008651618B2

(12) United States Patent
Tamaki et al.

(10) Patent No.: US 8,651,618 B2
(45) **Date of Patent: *Feb. 18, 2014**

(54) LIQUID EJECTION APPARATUS AND NONVOLATILE STORAGE MEDIUM STORING PROGRAM

(75) Inventors: Shuichi Tamaki, Nagoya (JP); Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/361,665

(22) Filed: Jan. 30, 2012

(65) Prior Publication Data

US 2012/0194605 A1 Aug. 2, 2012

(30) Foreign Application Priority Data

Jan. 31, 2011 (JP) ..... 2011-018954

(51) Int. Cl.
*B41J 2/165* (2006.01)

(52) U.S. Cl.
CPC ..... *B41J 2/1652* (2013.01); *B41J 2/16508* (2013.01)
USPC ..... 347/23; 347/29

(58) Field of Classification Search
USPC ..... 347/22–36
See application file for complete search history.

(56) References Cited

U.S. PATENT DOCUMENTS

| | | | | |
|---|---|---|---|---|
| 4,223,324 | A | 9/1980 | Yamamori et al. | |
| 2002/0060713 | A1 * | 5/2002 | Katakura et al. | 347/30 |
| 2005/0168517 | A1 | 8/2005 | Usuda | |
| 2009/0033707 | A1 | 2/2009 | Shimazaki | |
| 2009/0109257 | A1 * | 4/2009 | Shimazaki | 347/31 |
| 2009/0195593 | A1 | 8/2009 | Iwanaga | |
| 2012/0194584 | A1 | 8/2012 | Tamaki | |

FOREIGN PATENT DOCUMENTS

| | | | |
|---|---|---|---|
| JP | H03-184852 | A | 8/1991 |
| JP | 2003-334962 | A | 11/2003 |
| JP | 2005-212138 | A | 8/2005 |
| JP | 2006-159717 | A | 6/2006 |
| JP | 2009-034912 | A | 2/2009 |
| JP | 2009-184132 | A | 8/2009 |

OTHER PUBLICATIONS

European Patent Office, extended European Search Report for European Patent Application No. 12152831.9 (counterpart to above-captioned patent application), dated Jun. 14, 2012.

* cited by examiner

*Primary Examiner* — Jannelle M Lebron
(74) *Attorney, Agent, or Firm* — Baker Botts L.L.P.

(57) ABSTRACT

A liquid ejection apparatus, including: a head having ejection openings and configured to eject liquid through the ejection openings; a sealing mechanism configured to selectively establish a sealing state in which the sealing mechanism seals an ejection space in which the ejection openings are open, from an outside and an unsealing state in which the sealing mechanism does not seal the ejection space from the outside; and a humid-air supply mechanism configured to supply a humid air into the ejection space when the sealing mechanism is in the sealing state; wherein a controller is configured to control the humid-air supply mechanism such that an amount of the humid air to be supplied into the ejection space from the humid-air supply mechanism when the sealing mechanism is in the sealing state increases with a longer length of time of the unsealing state just before the current sealing state.

11 Claims, 11 Drawing Sheets

LIQUID EJECTION APPARATUS AND NONVOLATILE STORAGE MEDIUM STORING PROGRAM

CROSS REFERENCE TO RELATED APPLICATION

The present application claims priority from Japanese Patent Application No. 2011-018954, which was filed on Jan. 31, 2011, the disclosure of which is herein incorporated by reference in its entirety.

BACKGROUND OF THE INVENTION

1. Field of the Invention

The present invention relates to a liquid ejection apparatus configured to eject liquid such as ink and to a nonvolatile storage medium storing a program to be executed by the liquid ejection apparatus.

2. Description of the Related Art

There is conventionally known a fluid ejecting apparatus, as an ink-jet printer, configured to seal a space facing an ejection face of a head with a moisture-retention head cap when image recording is not performed, and configured to supply into the moisture-retention head cap water steam generated by a humidifier. In this fluid ejecting apparatus, a preliminary-ejection head cap into which ink is ejected is provided independently of the moisture-retention head cap, whereby the ink is not ejected into the moisture-retention head cap.

SUMMARY OF THE INVENTION

Inventors of the present invention have found that, even if a moisture-retention head cap into which ink is not ejected is used, ink mist flying around a head and ink having unintentionally leaked from nozzles are accumulated in the moisture-retention head cap with passage of usage time of a recording apparatus, and this accumulated ink in the cap functions as a drying agent, thereby speeding up drying of the ink in the nozzles after the capping of the moisture-retention head cap. In this case, merely the supply of the water steam generated by the humidifier into the moisture-retention head cap may be not enough to humidify the ink in the nozzles. It is noted that this can be applied to the head cap functioning as both of the preliminary-ejection head cap and the moisture-retention head cap.

This invention has been developed in view of the above-described situations, and it is an object of the present invention to provide a liquid ejection apparatus and a nonvolatile storage medium storing a program to be executed by the liquid ejection apparatus, capable of appropriately humidifying ejection openings even where liquid is accumulated in a cap.

The object indicated above may be achieved according to the present invention which provides a liquid ejection apparatus, comprising: a liquid-ejection head having an ejection face in which a plurality of ejection openings are formed, the liquid-ejection head being configured to eject liquid through the plurality of ejection openings to record an image on a recording medium; a sealing mechanism configured to selectively establish (i) a sealing state in which the sealing mechanism seals an ejection space in which the plurality of ejection openings are open, from an outside and (ii) an unsealing state in which the sealing mechanism does not seal the ejection space from the outside; a humid-air supply mechanism configured to supply a humid air into the ejection space when the sealing mechanism is in the sealing state; and a controller configured to control the humid-air supply mechanism such that an amount of the humid air to be supplied into the ejection space from the humid-air supply mechanism when the sealing mechanism is in the sealing state increases with a longer length of time of the unsealing state just before the current sealing state.

The object indicated above may be achieved according to the present invention which provides a nonvolatile storage medium storing a program to be executed by a liquid ejection apparatus, the liquid ejection apparatus comprising: a liquid-ejection head having an ejection face in which a plurality of ejection openings are formed, the liquid-ejection head being configured to eject liquid through the plurality of ejection openings to record an image on a recording medium; a sealing mechanism configured to selectively establish (i) a sealing state in which the sealing mechanism seals an ejection space in which the plurality of ejection openings are open, from an outside and (ii) an unsealing state in which the sealing mechanism does not seal the ejection space from the outside; and a humid-air supply mechanism configured to supply a humid air into the ejection space, the program comprising: controlling the humid-air supply mechanism such that an amount of the humid air to be supplied into the ejection space from the humid-air supply mechanism when the sealing mechanism is in the sealing state increases with a longer length of time of the unsealing state just before the current sealing state.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

First, there will be explained an overall construction of an ink-jet printer 1 as an embodiment of the present invention.

Figure 1:
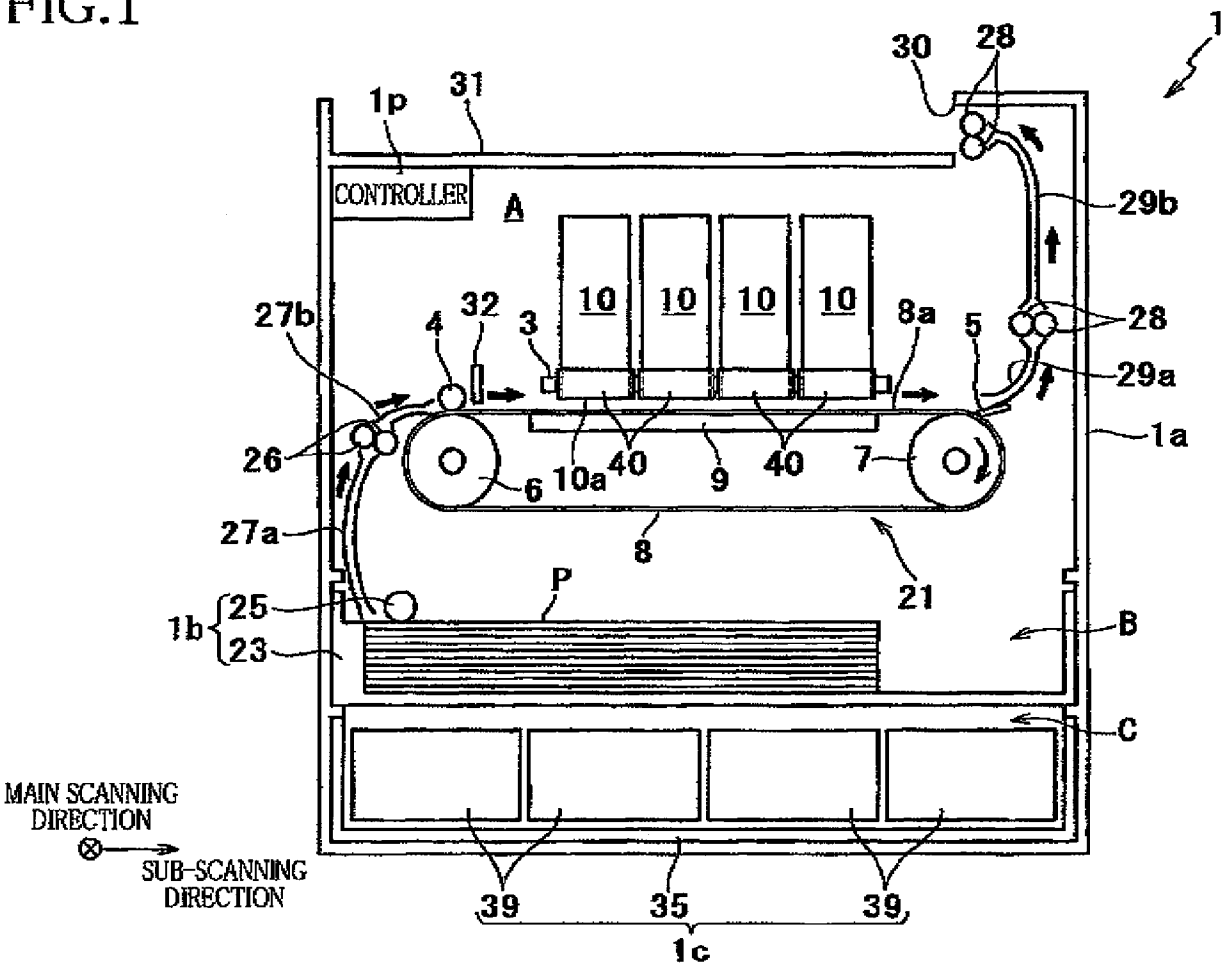
FIG. 1 is a side view generally showing an internal structure of an ink-jet printer as an embodiment of the present invention.

As shown in FIG. 1, the printer 1 includes a casing 1*a* having a rectangular parallelepiped shape. A sheet-discharge portion 31 is provided on a top plate of the casing 1*a*. An inner space of the casing 1*a* is divided into spaces A, B, and C in order from an upper side thereof. In the spaces A and B is formed a sheet conveyance path continuous to the sheet-discharge portion 31. In the space C are accommodated ink cartridges 39 each as an ink supply source for ink-jet heads 10 each as an example of a liquid-ejection head.

In the space A, there are arranged the four heads 10, a conveyance unit 21 for conveying a sheet P as an example of a recording medium, a guide unit for guiding the sheet P, a humidifying mechanism 50 (see FIG. 5) used for a humidifying maintenance, and so on. In an upper portion of the space A, there is disposed a controller 1*p* configured to control operations of components of the printer 1 to control an overall operation of the printer 1.

On the basis of image data transmitted from an external device, the controller 1*p* controls: a conveyance operation of components of the printer 1 for conveying the sheet P; an ink ejecting operation synchronized with the conveyance of the sheet P; a maintenance operation for recovering or maintaining an ejection characteristic; and so on. The maintenance operation includes flushing, purging, wiping, humidifying maintenance, and so on. The flushing is an operation for forcibly ejecting ink from a part of or all of ejection openings 14*a* by driving actuators of the head 10 on the basis of flushing data that is different from the image data. The purging is an operation for forcibly ejecting the ink from all of the ejection openings 14*a* by applying a pressure to the ink in the head 10 by, e.g., a pump. The wiping is an operation for wiping foreign matters on ejection faces 10*a* by a wiper after the flushing or the purging. The humidifying maintenance is an operation for supplying humid air into ejection spaces (inner spaces) S1 (see FIG. 5) respectively facing the ejection faces 10*a*. It is noted that the humidifying maintenance will be explained in more detail later.

The conveyance unit 21 includes (a) belt rollers 6, 7, (b) an endless conveyance belt 8 wound around the rollers 6, 7, (a) a nip roller 4 and a peeling plate 5 respectively disposed on opposite sides (outsides) of the conveyance belt 8, (d) a platen 9 disposed inside the conveyance belt 8, and so on. The belt roller 7 is a drive roller that is rotated in a clockwise direction in FIG. 1 by a conveyance motor, not shown. The conveyance belt 8 runs or is circulated along bold arrow in FIG. 1 in accordance with the rotation of the belt roller 7. The belt roller 6 is a driven roller that is rotated in the clockwise direction in FIG. 1 in accordance with the circulation of the conveyance belt 8. The nip roller 4 is disposed so as to face the belt roller 6 and press the sheet P supplied from an upstream side in a conveyance direction, onto a support face 8*a* of the conveyance belt 8 as an outer circumferential face thereof. The sheet P is then conveyed toward the belt roller 7 in accordance with the circulation of the conveyance belt 8 while being supported on the support face 8*a*. The peeling plate 5 is disposed so as to face the belt roller 7, and peels the sheet P from the support face 8*a* and then guides the sheet P toward a downstream side in the conveyance direction. The platen 9 is disposed so as to face the four heads 10 and support an upper loop of the conveyance belt 8 from an inside thereof.

Each of the heads 10 is a line head having a generally rectangular parallelepiped shape elongated in a main scanning direction in which each head 10 reciprocates. A lower face of each head 10 is the ejection face 10*a* having a multiplicity of the ejection openings 14*a* (see FIGS. 3 and 4) opened therein. In a recording operation, the four heads 10 eject inks of respective four colors, namely, magenta, cyan, yellow, and black from the respective ejection faces 10*a*. The four heads 10 are arranged in a sub-scanning direction at predetermined pitches and are supported by the casing 1*a* via a head holder 3. The head holder 3 supports the heads 10 such that the ejection faces 10*a* face the support face 8*a* of the upper loop of the conveyance belt 8 with a specific space therebetween for the recording operation. On the head holder 3 are provided the circular caps 40 each for covering an outer region of the ejection face 10*a* of a corresponding one of the heads 10. Specific constructions of the heads 10 and the head holder 3 will be explained later.

The guide unit includes an upstream guide portion and a downstream guide portion disposed with the conveyance unit 21 interposed therebetween. The upstream guide portion includes two guides 27*a*, 27*b* and a pair of conveyance rollers 26. The guide portion connects between a sheet-supply unit 1*b* (which will be described below) and the conveyance unit 21. The downstream guide portion includes two guides 29*a*, 29*b* and two pairs of conveyance rollers 28. This guide portion connects between the conveyance unit 21 and the sheet-discharge portion 31.

In the space B is disposed the sheet-supply unit 1*b* that is mountable on and removable from the casing 1*a*. The sheet-supply unit 1*b* includes a sheet-supply tray 23 and a sheet-supply roller 25. The sheet-supply tray 23 has a box-like shape opening upward so as to accommodate various sizes of the sheet P. The sheet-supply roller 25 is rotated to supply an uppermost one of the sheets P in the sheet-supply tray 23 toward the upstream guide portion.

As described above, in the spaces A, B is formed the sheet conveyance path extending from the sheet-supply unit 1*b* to the sheet-discharge portion 31 via the conveyance unit 21. On the basis of a recording command transmitted from the external device, the controller 1*p* drives a plurality of motors such as a sheet-supply motor, not shown, for the sheet-supply roller 25, a sheet-conveyance motor, not shown, for the conveyance rollers of each of the upstream and downstream guide portions, the above-described conveyance motor, and the like. The sheet P supplied from the sheet-supply tray 23 is supplied to the conveyance unit 21 by the conveyance rollers 26. When the sheet P passes through positions just under the heads 10 in the sub-scanning direction, the heads 10 eject the inks of the respective four colors in order from the respective ejection faces 10*a*, to record or form a color image on the sheet P. The ink ejection is performed on the basis of a detection signal outputted from a sheet sensor 32. The sheet P is then peeled by the peeling plate 5 and conveyed upward by the conveyance rollers 28. The sheet P is then discharged onto the sheet-discharge portion 31 through an opening 30.

Here, the sub-scanning direction is a direction parallel to the conveyance direction in which the sheet P is conveyed by the conveyance unit 21, and the main scanning direction is a direction parallel to a horizontal plane and perpendicular to the sub-scanning direction.

In the space C, an ink unit 1*c* is disposed so as to be mountable on and removable from the casing 1*a*. The ink unit 1*c* includes a cartridge tray 35 and the four cartridges 39 accommodated in the tray 35 side by side. The inks stored in the respective cartridges 39 are to be supplied to the respective heads 10 via respective ink tubes, not shown.

There will be next explained the construction of each head 10 with reference to FIGS. 2-4 and 7 in detail. It is noted that, in FIG. 3, pressure chambers 16 and apertures 15 are illustrated by solid lines for easier understanding purposes though these elements are located under actuator units 17 and thus should be illustrated by broken lines. It is further noted that, since the four heads 10 have the same construction, the following explanation will be given for one of the heads 10 for the sake of simplicity.

The head 10 includes a reservoir unit 11, a channel unit 12 (see FIG. 7), the eight actuator units 17 (see FIG. 2) fixed to an upper face 12*x* of the channel unit 12, a Flexible Printed Circuit (FPC) 19 (see FIG. 4) bonded to each of the actuator units 17 and so on which are stacked on one another in a vertical direction. In the reservoir unit 11 are formed ink channels including a reservoir that temporarily stores the ink supplied from the cartridge 39 (see FIG. 1). In the channel unit 12 are formed ink channels each extending from a corresponding one of openings 12*y* of the upper face 12*x* (see FIG. 2) of the channel unit 12 to a corresponding one of the ejection openings 14*a* formed in a lower face of the channel unit 12 (i.e., the ejection face 10*a*). The actuator units 17 include piezoelectric actuators for the respective ejection openings 14*a*.

Protruding portions and recessed portions are formed on and in a lower face of the reservoir unit 11. The protruding portions are bonded to the upper face 12*x* of the channel unit 12 at areas on which no actuator units 17 are disposed (noted that the areas include the openings 12*y* and are enclosed with two-dot chain lines in FIG. 2). A distal end face of each of the protruding portions has an opening connected to the reservoir and facing a corresponding one of the openings 12*y* of the channel unit 12. As a result, the reservoir and individual ink channels 14 are communicated with each other via the above-described openings. The recessed portions face the upper face 12*x* of the channel unit 12, faces of the respective actuator units 17, and a face of the FPC 19 with slight spaces formed therebetween.

Figure 2:
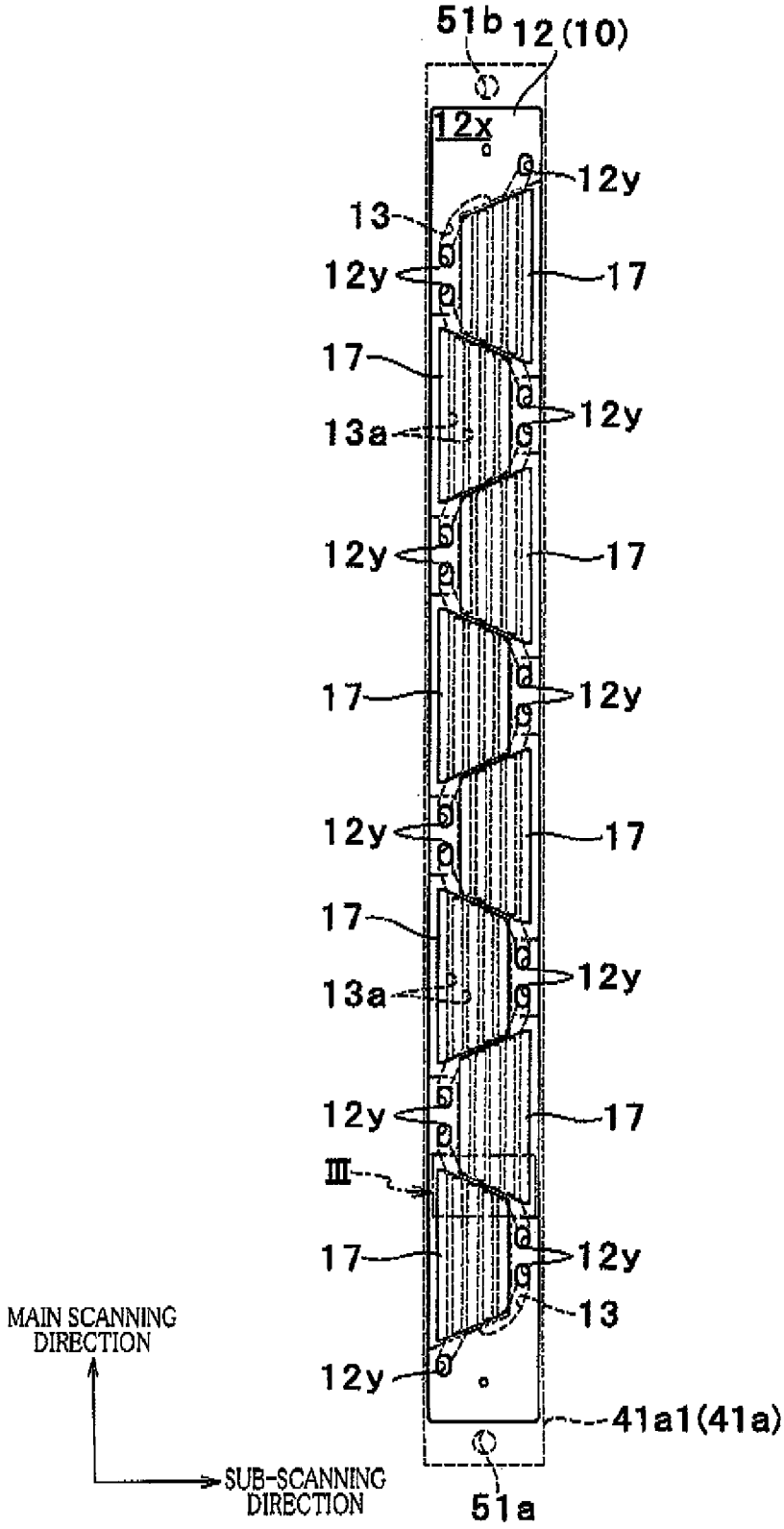
FIG. 2 is a plan view showing a channel unit and actuator units of each ink-jet head of the printer in FIG. 1.
Figure 3:
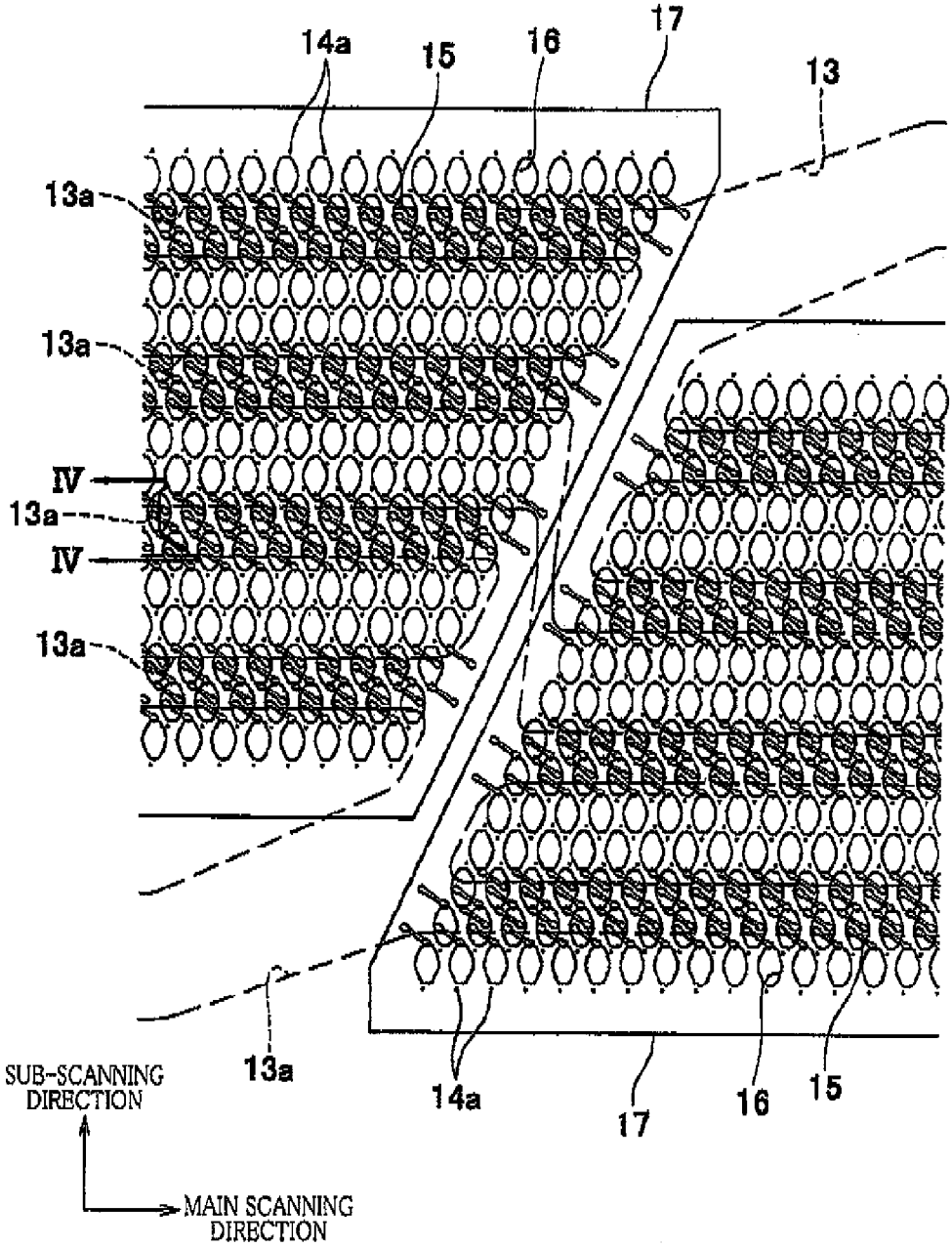
FIG. 3 is an enlarged view showing an area III enclosed by one-dot chain line in FIG. 2.
Figure 4:
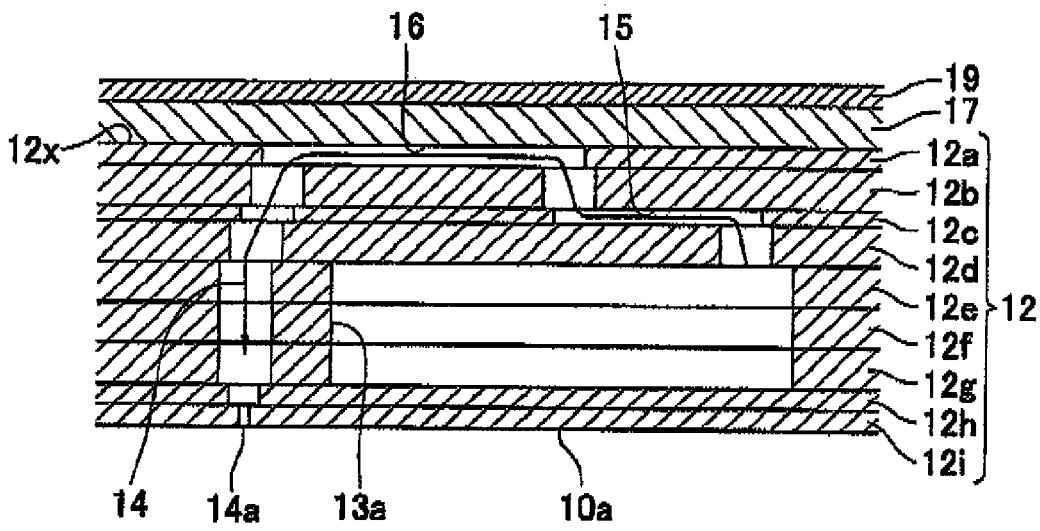
FIG. 4 is a partial cross-sectional view taken along line IV-IV in FIG. 3.

The channel unit 12 is a stacked body constituted by nine metal rectangular plates 12*a*-12*i* (sec FIG. 4) having generally the same size and bonded to one another. As shown in FIGS. 2-4, the channel unit 12 includes: manifold channels 13 each having a corresponding one of the openings 12*y* as one end; sub-manifold channels 13*a* each branched from a corresponding one of the manifold channels 13; the individual ink channels 14 respectively extending from outlets of the sub-manifold channels 13*a* to the ejection openings 14*a* via the pressure chambers 16. As shown in FIG. 4, the individual channel 14 is formed for each ejection opening 14*a* so as to have the aperture 15 functioning as a restrictor for adjusting a channel resistance. Generally rhombic openings for respectively exposing the pressure chambers 16 are formed in matrix in areas on the upper face 12*x* to which the actuator units 17 are respectively bonded. The ejection openings 14*a* are formed in matrix in the same pattern as the pressure chambers 16, in the lower face (i.e., the ejection face 10*a*) at areas opposed to the areas on the upper face 12*x* to which the actuator units 17 are respectively bonded.

As shown in FIG. 2, the actuator units 17 each having a trapezoid shape are arranged on the upper face 12*x* in two arrays in a staggered configuration. As shown in FIG. 3, each of the actuator units 17 covers the multiplicity of the pressure chambers 16 formed under the actuator unit 17. Though not shown, each of the actuator units 17 includes: a plurality of piezoelectric layers expanding over the multiplicity of the pressure chambers 16; and electrodes interposing the piezoelectric layers in a thickness direction of the actuator units 17. The electrodes include: a common electrode common for the pressure chambers 16 and individual electrodes provided for the respective pressure chambers 16. The individual electrodes are formed on a face of an uppermost one of the piezoelectric layers.

The FPC 19 has wirings corresponding to the respective electrodes of the actuator units 17, and a driver IC, not shown, is mounted on the wirings. The FPC 19 is fixed at one end thereof to the actuator units 17 and at the other end to a control board, not shown, of the head 10, which is disposed on an upper side of the reservoir unit 11. Under the control of the controller 1*p* (see FIG. 1), the FPC 19 sends the driver IC various drive signals outputted from the control board and sends the actuator units 17 signals produced by the driver IC.

Figure 5:
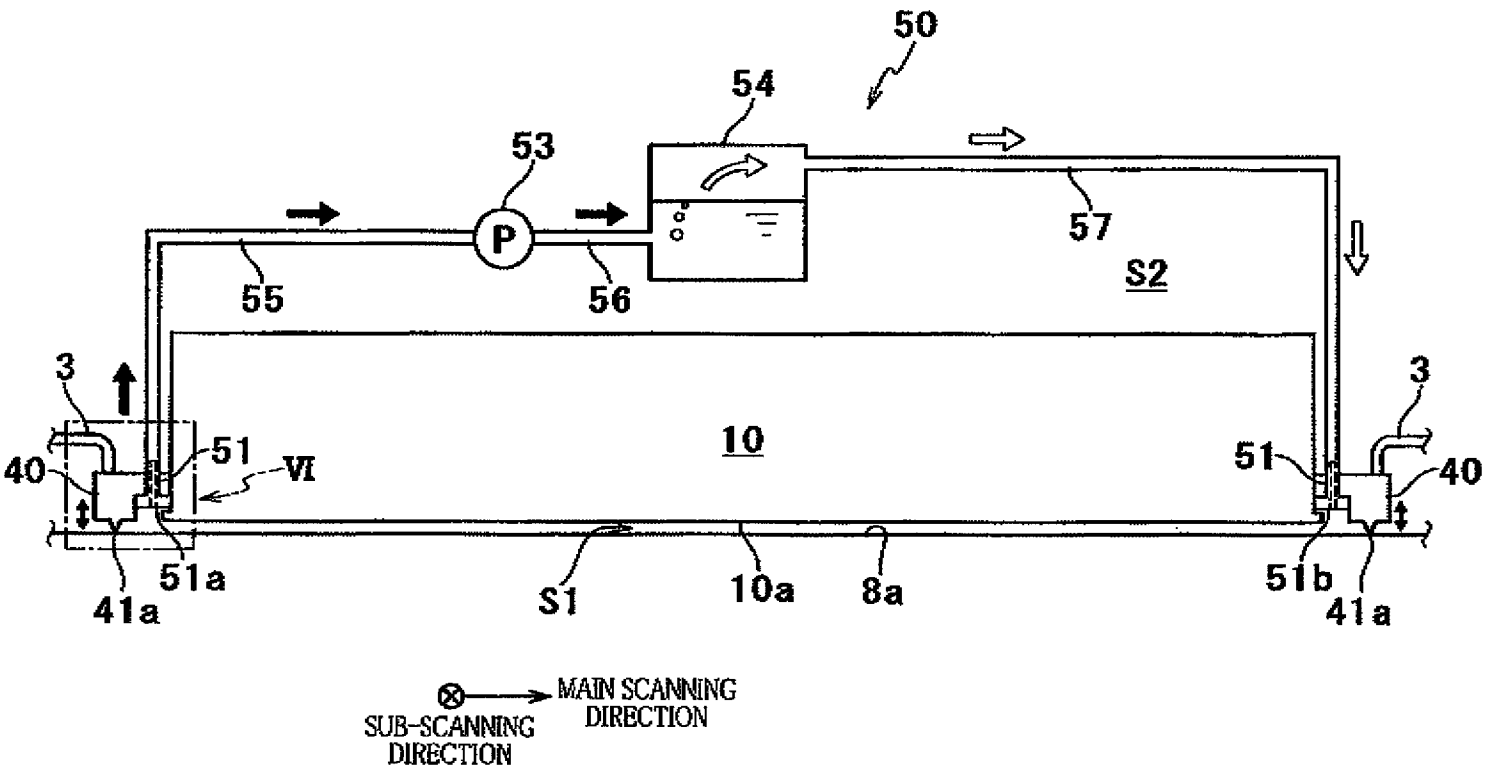
FIG. 5 is a schematic view showing a head holder and a humidifying mechanism of the printer in FIG. 1.
Figure 6:
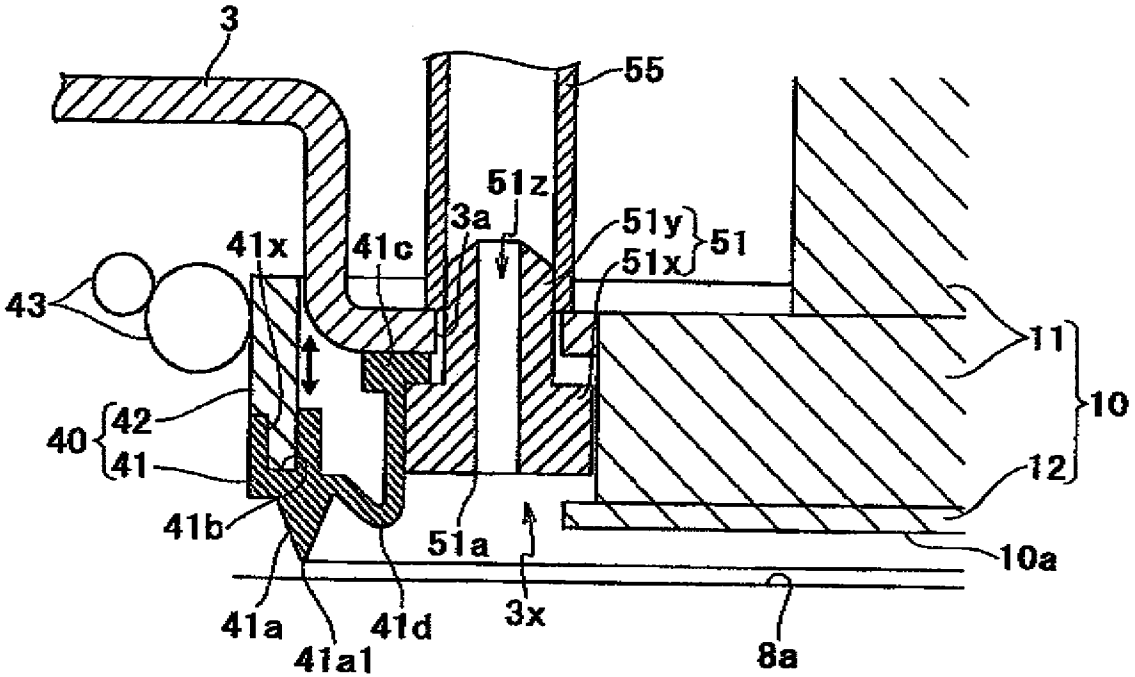
FIG. 6 is a partial cross-sectional view showing an area VI enclosed with a one-dot chain line in FIG. 5.

There will be next explained a construction of the head holder 3 with reference to FIGS. 2, 5, and 6.

The head holder 3 is a frame made of a metal, for example. For each head 10, the cap 40 and a pair of joints 51 are mounted on the head holder 1

As shown in FIG. 5, each pair of the joints 51 respectively constitute one and the other ends of the circulation channel of the humidifying mechanism 50 and are respectively disposed near one and the other ends of a corresponding one of the heads 10 in a longitudinal direction thereof. In the humidifying maintenance, an air is sucked through an opening (outlet opening) 51*a* formed in a lower face of one of the pair of the joints S1 (the left joint 51 in FIG. 5), and a humid air is supplied through an opening (inlet opening) 51*b* formed in a lower face of the other of the pair of the joints 51.

As shown in FIG. 6, each of the joints 51 has a generally cylindrical shape and has a basal end portion 51*x* and a distal end portion 51*y* extending from the basal end portion 51*x*. A hollow space 51*z* is formed through the basal end portion 51*x* and the distal end portion 51*y* in the vertical direction. The basal end portion 51*x* and the distal end portion 51*y* have different outside diameters from each other, specifically, the basal end portion 51*x* has a greater outside diameter than that of the distal end portion 51*y*. The hollow space 51*z* has a uniform diameter along the vertical direction. The distal end portion 51*y* has a cutout in an outer face of an upper end thereof. A diameter of an upper end portion of the distal end portion 51*y* decreases from a lower side to an upper side thereof, that is, the upper end portion of the distal end portion 51*y* is tapered. This facilitates a connection of one end of a tube 55 or 57 to the distal end portion 51*y*.

The joints 51 are fixed to the head holder 3 in a state in which the distal end portions 51*y* are inserted and fitted in respective through holes 3*a* of the head holder 3. The through holes 3*a* are formed at respective positions at which the joints 51 are disposed on the head holder 3, that is, the through holes 3*a* are respectively formed near one and the other ends of the head 10 in the longitudinal direction thereof. The outside diameter of the distal end portion 51*y* is one size smaller than that of the through hole 3*a*. Thus, a small space is formed between an outer circumferential face of the distal end portion 51*y* and a wall face defining the through hole 3*a* of the head holder 3. This space is sealed by, e.g., a sealing material when the joint 51 is fixed to the head holder 3.

Each cap 40 has a circular shape in plan view for enclosing an outer peripheral area of the ejection face 10*a* of the corresponding head 10. The cap 40 includes: an elastic member 41 supported by the head holder 3 via a fixed portion 41*c*; and a movable member 42 movable upward and downward.

The elastic member 41 is formed of an elastic material such as a rubber and includes (a) a base portion 41*x*, (b) a projecting portion 41*a* projecting downward from a lower face of the base portion 41*x* so as to have an inverted triangle shape in cross section, (c) the fixed portion 41*c* having a T-shape in cross section and fixed to the head holder 3, and (e) a connecting portion 41*d* for connecting the base portion 41*x* and the fixed portion 41*c* to each other. The elastic member 41 has a circular shape in plan view for enclosing the outer peripheral area of the ejection face 10*a*. An upper end portion of the fixed portion 41*c* is fixed to the head holder 3 by adhesive, for example. The fixed portion 41*c* is sandwiched near the through hole 3*a* between the head holder 3 and the basal end portion 51*x* of the joint 51. The connecting portion 41*d* extends from a lower end of the fixed portion 41*c* and curves to an outside in a direction away from the ejection face 10*a* in plan view, so as to be connected to a lower end of the base portion 41*x*. The connecting portion 41*d* is deformable so as to be deformed according to the upward and downward movement of the movable member 42. An upper face of the base portion 41*x* has a recessed portion 41*b* that is fitted on a lower end of the movable member 42.

The movable member 42 is formed of a rigid material and has a circular shape in plan view for enclosing an outer peripheral area of the ejection face 10*a* of the head 10 like the elastic member 41. The movable member 42 is supported by the head holder 3 via the elastic member 41 so as to be movable relative to the head holder 3 in the vertical direction. Specifically, the movable member 42 is connected to a plurality of gears 43 and moved upward and downward by the gears 43 rotated by a drive power outputted from an up-down motor 44 (see FIG. 8) under the control of the controller 1*p*. In this upward and downward movement of the movable member 42, the base portion 41*x* is also moved upward and downward with the movable member 42 because the lower end of the movable member 42 is fitted in the recessed portion 41*b* of the elastic member 41. When the movable member 42 is moved upward and downward, the projecting portion 41*a* is also moved upward and downward in the state in which the fixed portion 410 is fixed to the head holder 3. As a result, a position of a distal end 41*a*1 of the projecting portion 41*a* relative to the ejection face 10*a* in the vertical direction is changed.

According to the upward and downward movement of the movable member 42, the projecting portion 41*a* is selectively positioned at a contact position (see FIG. 5) at which the distal end 41*a*1 is held in contact with the support face 8*a* of the conveyance belt S and at a distant position (see FIG. 6) at which the distal end 41*a*1 is distant from the support face 8*a* of the conveyance belt 8. As shown in FIG. 5, when the projecting portion 41*a* is positioned at the contact position, a capping state (airtight sealing state) is established in which the ejection space S1 formed between the ejection face 10*a* and the support face 8*a* is isolated from or does not communicate with an outside space 52. As shown in FIG. 6, when the projecting portion 41*a* is positioned at the distant position, an uncapping state (unsealing state) is established in which the ejection space S1 communicates with the outside space S2. It is noted that the ejection space S1 is a space facing the ejection face 10; in other words, the ejection space S1 is the space in which the plurality of the ejection openings 14*a* formed in the ejection face 10*a* are opened, in other words, the ejection space S1 is the space to which the ink is ejected from the plurality of the ejection openings 14*a*. It is further noted that the caps 40 and the support faces 8*a* can be considered as examples of a sealing mechanism.

The projecting portion 41*a* is distant from the ejection face 10*a* over an entire perimeter of the ejection face 10*a* (i.e., the lower face of the head 10 in FIG. 2) in plan view.

Figure 7:
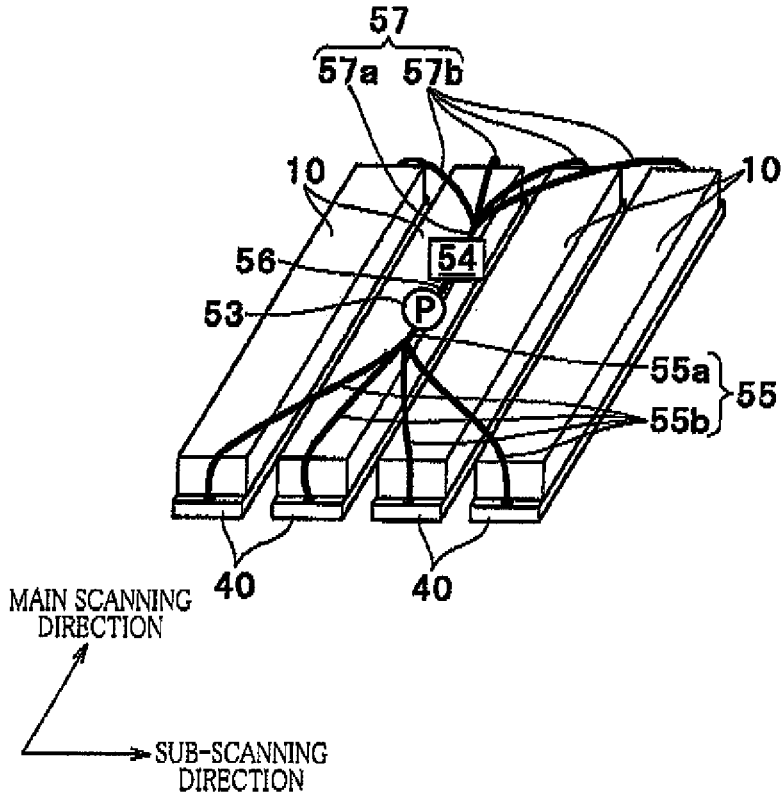
FIG. 7 is a schematic view showing connection between all the heads of the printer in FIG. 1 and a humidifying mechanism.

There will be next explained a construction of the humidifying mechanism 50 with reference to FIGS. 5 and 7.

As shown in FIG. 5, the humidifying mechanism 50 as one example of a humid-air supply mechanism includes the joints 51, the tubes 55, 57, a tube 56, a pump 53, and a tank 54. Although the pair of the joints 51 are provided for each head 10, as shown in FIG. 7, the single pump 53 and the single tank 54 are provided in the printer 1, that is, the single pump 53 and the single tank 54 are provided for the four heads 10 (see FIG. 7). The tube 55 includes a main portion 55*a* common for the four heads 10 and four branch portions 55*b* branched from the main portion 55*a* and each extending to a corresponding one of the joints 51. Likewise, the tube 57 includes a main portion 57*a* common for the four heads 10 and four branch portions 57*b* branched from the main portion 57*a* and each extending to a corresponding one of the joints 51.

One ends of the tube 55 (distal ends of the respective branch portions 55*b*) are respectively fitted on the distal end portions 51*y* of the joints 51 (left joints 51 in FIG. 5) provided on the respective heads 10. The other end of the tube 55 (an end of the main portion 55*a* opposite to the branch portions 55*b*) is connected to the pump 53. That is, the tube 55 communicably connects the pump 53 and the hollow space 51*z* of one of each pair of the joints 51 to each other. The tube 56 communicably connects the pump 53 and the tank 54 to each other. One ends of the tube 57 (distal ends of the respective branch portions 57*b*) are respectively fitted on the distal end portions 51*y* of the joints 51 (right joints 51 in FIG. 5) provided on the respective heads 10. The other end of the tube 57 (an end of the main portion 57*a* opposite to the branch portions 57*b*) is connected to the tank 54. That is, the tube 57 communicably connects the tank 54 and the hollow space 51*z* of the other of each pair of the joints 51 to each other.

The tank 54 stores water in its lower space and stores in its upper space the humid air humidified by the water stored in the lower space. The tube 56 is connected to a side face of the tank 54 below a water surface (i.e., an upper surface of the water), that is, the tube 56 is connected to the lower space of the tank 54. The tube 57 is connected to another side face of the tank 54 above the water surface, that is, the tube 57 communicates with the upper space of the tank 54. It is noted that a check valve, not shown, is provided on the tube 56 for preventing the water in the tank 54 from flowing into the pump 53, resulting in that the air flows only in a direction indicated by arrows in FIG. 5.

Figure 8:
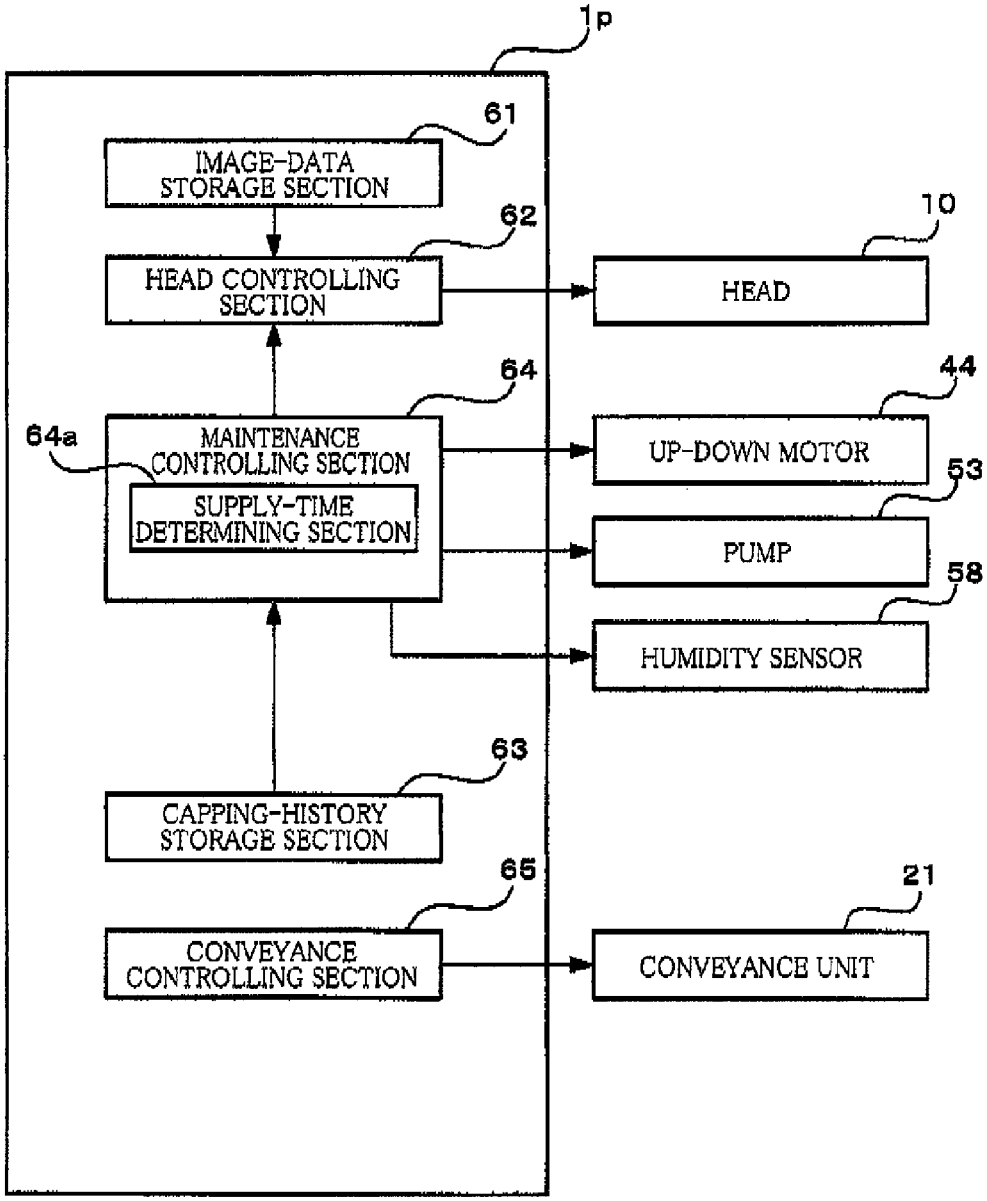
FIG. 8 is a block diagram showing functions of a controller of the printer in FIG. 1.

There will be next explained the controller 1*p*. The controller 1*p* includes a Central Processing Unit (CPU); a nonvolatile memory for rewritably storing programs executed by the CPU and data used for these programs; and a Random Access Memory (RAM) for temporarily storing the date upon the execution of the program. The controller 1*p* includes various functional sections which are constituted by cooperation of these hardwares and softwares in the nonvolatile memory with each other. These programs are stored in various storage media such as a flexible disc, a CD-ROM, and a memory card, and installed from these storage medium into the nonvolatile memory. It is noted that control programs stored in the storage medium may be programs to be executed directly by the CPU and may be programs that become executable by being installed to the nonvolatile memory. Further, the control programs may be encrypted and/or compressed. As shown in FIG. 8, the controller 1*p* includes an image-data storage section 61, a head controlling section 62, a capping-history storage section 63, a maintenance controlling section 64, and a conveyance controlling section 65.

The image-data storage section 61 stores the image data based on which an image is recorded on the sheet P. The conveyance controlling section 65 is configured to control the conveyance unit 21 such that the sheet P is conveyed through the sheet conveyance path at a predetermined speed. The head controlling section 62 is configured to control the heads 10 such that the image is recorded on the sheet P conveyed by the conveyance unit 21 on the basis of the image data stored in the image-data storage section 61, and such that the flushing is performed in the maintenance operation.

The capping-history storage section 63 stores therein a history of the uncapping state of each cap 40, a time corresponding to a remaining time of a supply time (which will be described below), an elapsed time elapsed from the last ejection of the ink from the ejection opening(s) 14*a*, and so on.

The maintenance controlling section 64 is configured to control the pump 53 of the humidifying mechanism 50 and the up-down motor 44 for moving upward and downward the movable members 42 (the distal ends 41*a*1 of the respective projecting portions 41*a*) in order to perform the humidifying maintenance. The humidifying maintenance is an operation for humidifying the inside of each ejection space S1 in the state in which the cap 40 is in the capping state, and the humidifying maintenance is started after the image recording is completed. It is noted that the heads 10, the head holder 3, and the conveyance belt 8 are located at their respective predetermined positions during operations of the humidifying maintenance which will be described below. The head holder 3 is positioned while holding the heads 10 such that a predetermined space suitable for the recording is formed between the ejection faces 10*a* and the support face 8*a*.

In the humidifying maintenance, the maintenance controlling section 64 initially rotates the gears 43 to lower the movable member 42. The projecting portion 41*a* is located at the distant position (see FIG. 6) in the recording but moved to the contact position (see FIG. 5) by the downward movement of the movable member 42. As a result, the ejection space S1 is sealed to establish the capping state. It is noted that, in a standby state or a sleep (suspended) state other than the recording, the maintenance controlling section 64 moves the projecting portion 41*a* to the contact position to establish the capping state.

The maintenance controlling section 64 includes a supply-time determining section 64*a* configured to determine a length of time for driving the pump 53 (i.e., the supply time for supplying the humid air into the ejection space S1) such that a density or a viscosity of the ink in the ejection openings 14*a* is equal to or lower than a proper value. Here, the supply-time determining section 64*a* calculates the supply time such that the longer a length of time of a preceding (the last) uncapping state of the cap 40, which time is obtained by the capping history storage section 63, the longer the supply time in the current state is. The supply-time determining section 64*a* then corrects the obtained supply time such that, the longer the elapsed time elapsed from the last ejection of the ink from any of the ejection openings 14*a*, the longer the supply time in the current state is. Further, the supply-time determining section 64*a* corrects the obtained supply time such that the supply time is made longer, where a humidity detected by a humidity sensor 58 for detecting a humidity of an ambient air of the cap or caps 40 is equal to or lower than a predetermined value. It is noted that the proper value of the ink density is within a range in which a deterioration of the image is not caused when the image is formed on the sheet P by the ejection of the ink thereon, and this proper value is normally obtained by experiment. Further, the proper value of the ink viscosity is within a range in which the ink is stably ejected from the heads 10 onto the sheet P, and this proper value is normally obtained by experiment. It is noted that the humidity sensor 58 is for detecting the humidity of the ambient air of the caps 40 and disposed around the caps 40 in the outside space S2. It is noted that, since it can be considered that a humidity of the space in the casing 1*a* is generally the same at any positions in the space, the humidity sensor 58 can be disposed at any position in the casing 1*a*.

The maintenance controlling section 64 then drives the pump 53 to suck the air in each ejection space S1 through the opening 51*a* of the corresponding joint 51. In this operation, the air sucked through the opening 51*a* is moved to the pump 53 through the hollow space 51*z* of the joint 51 and the tube 55 and then to the tank 54 through the tube 56. The air is supplied to the lower space of the tank 54 (on a lower side of the water surface). The air humidified by the water in the tank 54 (the humid air) is discharged from the upper space of the tank 54. The humidity of the humid air discharged from the upper space of the tank 54 is a value near 100%. It is noted that the humidity of the humid air may be any value as long as the humidity is higher than the environmental humidity (i.e., a predetermined humidity that is the humidity of the outside space 52 around the caps 40). This humid air is supplied to the ejection space S1 from the opening 51*b* of the joint 51 through the tube 57. In FIG. 5, boldface arrows indicate the flow of the air before the humidification, and outline (white) arrows indicate the flow of the air after the humidification. In response to the above-described driving of the pump 53, the maintenance controlling section 64 controls switching valves, not shown, and so on provided on the branch portions 55*b*, 57*b* shown in FIG. 7 to selectively adjust the flows of the air in the branch portions 55*b*, 57*b*.

The supply of the humid air from the opening 51*b* into the ejection space S1 increases humidity in the ejection space S1. As the humidity in the ejection space S1 increases, the ink accumulated in the cap 40 is humidified, and the density and the viscosity of the ink in the ejection openings 14*a* are lowered. The maintenance controlling section 64 stops the driving of the pump 53 when the supply time obtained as described above has passed from the start of the driving of the pump 53. As a result, the humidifying maintenance is completed. It is noted that the humidity of the ejection space S1 lowers by, e.g., leaking of the humid air. In order to solve this problem, each time when a predetermined length of time (as one example of a first predetermined period) passes after the completion of the humidifying maintenance, the maintenance controlling section 64 drives the pump 53 again for a specific length of time to repeat the humidification of the ejection space S1. It is noted that the first predetermined period is a predetermined length of time extending from the start of the capping state to a point in time when the supply of the humid air into the ejection space S1 is required again after the humidity of the ejection space S1 in the capping state lowers with the passage of time from the stop of the supply of the humid air.

It is noted that the maintenance controlling section 64 discontinues the humidifying maintenance and stops the driving of the pump 53 when having received the recording command before the supply time obtained as described above has passed from the start of the driving of the pump 53. Where a predetermined length of time (as one example of a second predetermined period) has not passed from the start of the driving of the pump 53 when the receiving command has been received, the maintenance controlling section 64 changes a state of the printer 1 to a recording state after flushing of the ink from the ejection openings 14*a* (ink ejection not contributing to or not related to the image forming) is performed. Where the predetermined length of time has passed from the start of the driving of the pump 53 when the receiving command has been received, the maintenance controlling section 64 changes the state of the printer 1 to the recording state without the flushing. Thereafter, when the humidifying maintenance is started again after the image recording based on the recording command is completed, the supply-time determining section 64*a* adds, to the supply time obtained as described above, the time corresponding to the remaining time of the supply time. It is noted that the time corresponding to the remaining time ate supply time is the remaining time itself (a period obtained by subtracting, from the obtained supply time, a period from the start of the driving of the pump 53 to the stop of the driving of the pump 53) or a time obtained by multiplying the remaining time by a specific coefficient, for example. Here, the second predetermined period is a length of time extending from the start of the driving of the pump 53 to a point in time when each of all of the humidity of the ejection space S1, a density of the ink near the ejection openings 14*a*, and a density of the ink other than the ink near the ejection openings 14*a* becomes the proper value of the ink density or the ink viscosity (in other words, when each of all of the humidity and densities becomes constant). Where the driving of the pump 53 is stopped before the second predetermined period has passed, the ink density of the ink near the ejection openings 14*a* is higher than the proper value (or the ink viscosity is higher than the proper value). Thus, flushing for discharging only the ink having a relatively high density or viscosity can prevent a lowering of ejection characteristics and the image deterioration. Further, a reason why the time corresponding to the remaining time of the supply time is added to the obtained supply time is for the following reason, for example. That is, each of the ink viscosity and so on (including the ink density) in the ejection openings 14*a* is the proper value, but a viscosity and so on of the ink accumulated in the ejection space S1 is less than the proper value. Thus, only the supply of the humid air for the obtained supply time is not enough for humidifying the ink accumulated in the ejection space S1 such that each of the viscosity and so on thereof becomes the proper value (in other words, each of the viscosity and so on becomes constant), resulting that the ink accumulated in the ejection space S1 functions as a drying agent. As a result, it becomes impossible to humidifying the ink in the ejection openings 14*a* to the proper value.

Figure 9:
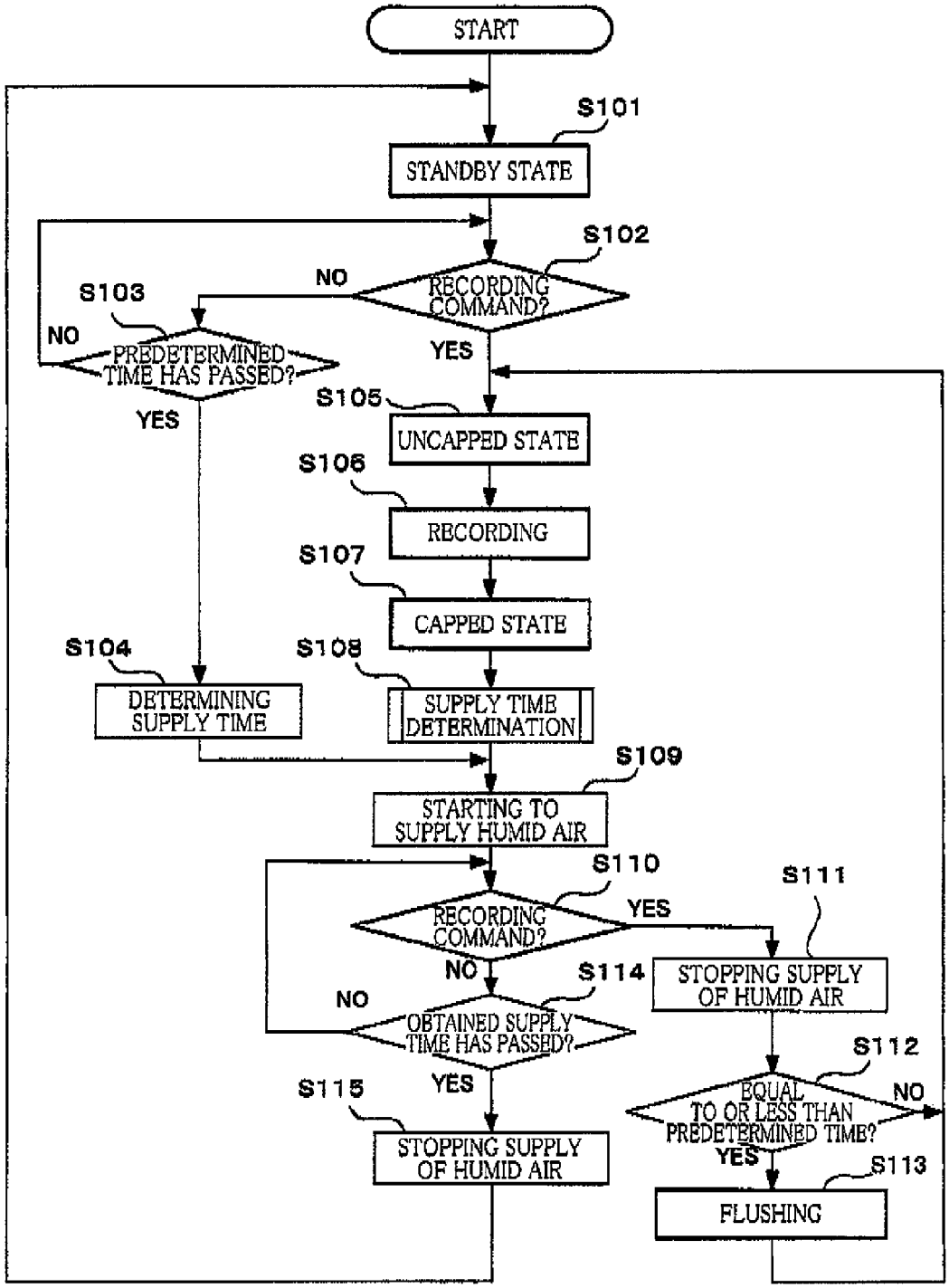
FIG. 9 is a flow-chart showing a recording operation of the printer in FIG. 1.

There will be next explained the recording operation in the printer 1 with reference to FIG. 9. As shown in FIG. 9, in S101, the maintenance controlling section 64 changes the state of the cap 40 to the capping state to change the state of the printer 1 to a standby state after the completion of the image recording. Where the maintenance controlling section 64 has not received the recording command (S102: NO), the controller 1*p* in S103 judges whether or not a predetermined time has passed from a point in time when the cap 40 becomes the capping state. Where the predetermined time has not passed (S103: NO), the controller 1*p* repeats the judgment in S102. Where the predetermined time has passed from the point in time when the cap 40 becomes the capping state (S103: YES), the maintenance controlling section 64 in S104 determines the supply time as the predetermined time and in S109 drives the pump 53 to start the supply of the humid air into the ejection space S1.

Where the recording command has been received (S102: YES), the maintenance controlling section 64 in S105 changes the state of the cap 40 from the capping state to the uncapping state and the capping-history storage section 63 stores a time at which the uncapping state is started. Then in S106, the image recording is performed on the basis of the received recording command.

Figure 10:
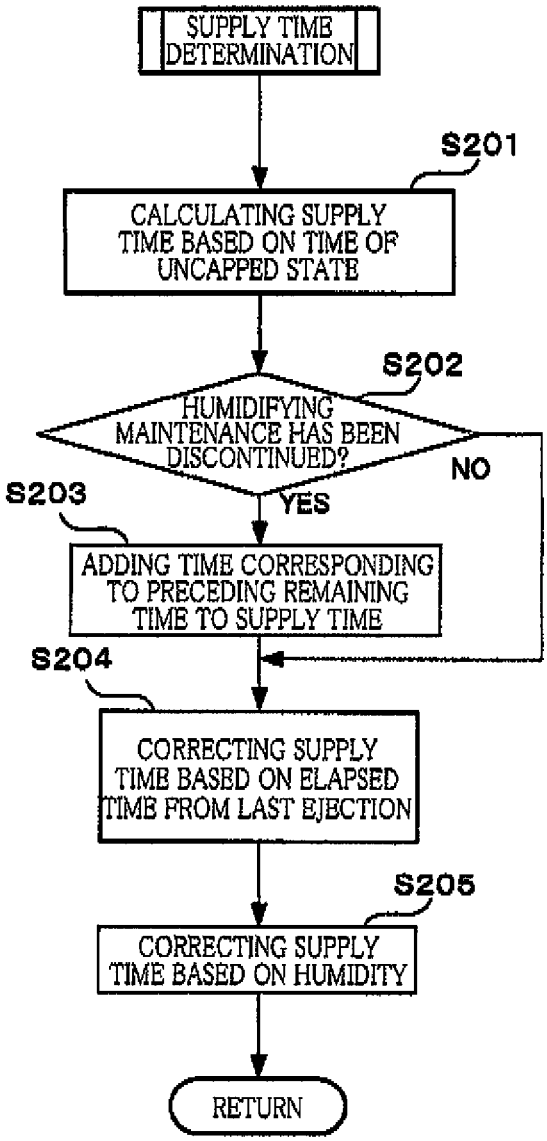
FIG. 10 is a flow-chart showing a supply time determination in FIG. 9.

When the image recording is completed, the maintenance controlling section 64 in S107 starts the humidifying maintenance by changing the state of the cap 40 from the uncapping state to the capping state, and the capping-history storage section 63 stores a time at which the last uncapping state is finished. Then in S108, the supply-time determining section 64*a* determines the supply time. As shown in FIG. 10, in this determination, the supply-time determining section 64*a* in S201 calculates the supply time such that the longer the length of time of the preceding uncapping state of the cap 40, which time is obtained by the capping history storage section 63, the longer the supply time is. Then in S202, the supply-time determining section 64*a* judges whether the humidifying maintenance has been discontinued or not. Where the humidifying maintenance has been discontinued (S202: YES), the controller 1*p* in S203 adds the time corresponding to the remaining time of the supply time to the obtained supply time. Then in S204, the supply-time determining section 64*a* then corrects the obtained supply time such that, the longer the elapsed time elapsed from the last ejection of the ink from any of the ejection openings 14*a*, the longer the supply time is. Further, in S205, the supply-time determining section 64*a* corrects the obtained supply time such that the supply time is made longer, where the humidity detected by the humidity sensor 58 for detecting the humidity of the ambient air of the caps 40 is equal to or lower than the predetermined value.

Returning to the flow-chart in FIG. 9, the maintenance controlling section 64 in S109 drives the pump 53 to supply the humid air into the ejection space S1. Then in S110, the maintenance controlling section 64 judges whether a new recording command has been received during the supply of the humid air or not. Where a new recording command has been received (S110: YES), the maintenance controlling section 64 in S111 stop the pump 53 to stop the supply of the humid air into the ejection space S1. Where the predetermined time (the second predetermined period) has not passed at this time from the start of the driving of the pump 53 (S112: YES), the flushing of the ink from the ejection openings 14*a* is performed in S113, and then in S105 the state of the cap 40 is changed from the capping state to the uncapping state, and the above-described processings are repeated. Further, where the predetermined time (the second predetermined period) has passed from the start of the driving of the pump 53 (S112: NO) at the time when a new recording command has been received (S110: YES), the maintenance controlling section 64 executes the processings S105 and subsequent steps without flushing of the ink from the ejection openings 14*a*.

Where a new recording command has not been received (S110: NO), the maintenance controlling section 64 in S114 judges whether the supply time obtained or determined as described above has passed from the start of the driving of the pump 53 or not. Where the supply time has not passed (S114: NO), the maintenance controlling section 64 in S110 judges again whether a new recording command has been received or not. Where the supply time has passed (S114: YES), the maintenance controlling section 64 in S115 stops the pump 53 to stop the supply of the humid air into the ejection space S1 and in S101 changes the state of the printer 1 to the standby state.

As described above, in this printer 1, the longer the time of the last or preceding uncapping state, the longer the time for supplying the humid air is made. Thus, even where the water (moisture) of the humid air supplied into the ejection space S1 of the cap 40 is sucked into the ink accumulated in an area of the cap 40 facing the ejection space S1 (e.g., ink mist flying around the head 10 and the ink unintentionally leaked from the ejection openings 14*a*), the humidification of the ejection space S1 can be performed such that the ink density or the ink viscosity in the cap 40 becomes the proper value. That is, even where the ink is accumulated in the cap 40, the humidification can be performed into the ejection space S1 appropriately.

Further, when the humidifying maintenance is discontinued by receiving the recording command before the supply time has passed from the start of the driving of the pump 53, the supply-time determining section 64*a* adds the time corresponding to the remaining time of the supply time when the humidifying maintenance has been discontinued, to the obtained supply time in the next humidifying maintenance. As a result, even where the ink is accumulated in the cap 40, the humidification of the ejection openings 14*a* can be reliably performed.

Further, since the supply-time determining section 64*a* makes the supply time longer where the humidity detected by the humidity sensor 58 for detecting the humidity of the ambient air of the caps 40 is equal to or lower than the predetermined value, it is possible to accurately adjust the humidity of the ejection space S1.

Further, when the predetermined time has passed from the completion of the humidifying maintenance, the ejection space S1 is humidified again. Thus, even where the cap 40 is in the capping state, the lowering of the humidity of the ejection space S1 with the passage of time can be prevented, making it possible to prevent the increase in the ink viscosity or the ink density in the ejection openings 14*a*.

In addition, the supply time for supplying the humid air into the ejection space S1 is determined such that the density or the viscosity of the ink in the ejection openings 14*a* is equal to or lower than the proper value, it is possible to prevent the lowering of the ink ejection characteristics due to increased viscosity of the ink in the ejection openings 14*a* by the drying.

Further, the supply time is determined such that, the longer the elapsed time elapsed from the last ejection of the ink from any of the ejection openings 14*a*, the longer the supply time is made. Thus, it is possible to prevent the lowering of the ink ejection characteristics due to the increased viscosity of the ink in the ejection openings 14*a* by the drying.

Further, when the recording command has been received before the predetermined time shorter than the obtained supply time has passed from the start of the driving of the pump 53, the state of the printer 1 is changed to the recording state after the humidifying maintenance is discontinued and the flushing of the ink from the ejection openings 14*a* is performed. Thus, it is possible to discharge only a low density part of the ink of the ejection openings 14*a*.

Further, in the humidifying maintenance, the air sucked through the opening 51*a* is moved to the pump 53 through the hollow space 51*z* of the joint 51 and the tube 55 and then to the tank 54 through the tube 56. The air is then moved through the tube 57 and supplied from the opening 51*b* into the ejection space S1. Since this circulation allows reuse of the humid air, the humid air can be speedily supplied. Further, the humid air can be supplied in the state in which the ejection space S1 is sealed.

Further, the distal end 41*a*1 is selectively positioned at the contact position at which the distal end 41*a*1 is held in contact with the support face 8*a* of the conveyance belt 8 and at the distant position at which the distal end 41*a*1 is distant from the support face 8*a* of the conveyance belt 8. Thus, the ejection spaces S1 can be reliably sealed by a simple construction. Further, it is possible to speedily change the capping state and the uncapping state to each other.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

In the above-described embodiment, the time (period) of the supply of the humid air is adjusted in, e.g., S201, but an amount of the humid air to be supplied from the humidifying mechanism 50 into the ejection space S1 may be adjusted on the basis of e.g., a time (period) of a preceding uncapping state. For example, as the processing corresponding to S201, the amount of the humid air to be supplied from the humidifying mechanism 50 into the ejection space S1 may be increased with the longer preceding uncapping state. Further, as the processing corresponding to S203, where the last or preceding humidification control is discontinued, a remaining amount of the supply amount (an amount obtained by subtracting, from a supply amount determined in advance, an amount of the humid air supplied in the period from the start of the driving of the pump 53 to the stop of the driving of the pump 53) in the last humidification may be added to a humid-air supply amount in a current humidification. Further, as the processing corresponding to S204, the supply amount of the humid air in the current humidification may be increased with the longer elapsed time elapsed from the last ink ejection before the current humidification. Further, as the processing corresponding to S205, where the humidity detected by the humidity sensor 58 is equal to or lower than the predetermined value, the supply amount of the humid air may be corrected to be made larger.

It is noted that the amount of the humid air to be supplied from the humidifying mechanism 50 into the ejection space S1 can be increased by lengthening the time for supplying the humid air as in the above-described embodiment or by increasing an amount of the humid air discharged per unit time by the pump 53 of the humidifying mechanism 50. In the latter case, the supply amount of the humid air can be increased without lengthening the supply time of the humid air. It is noted that the supply amount of the humid air may be increased by lengthening the time for supplying the humid air and increasing the amount of the humid air discharged per unit time by the pump 53.

For example, in the above-described embodiment, when the humidifying maintenance is discontinued by receiving the recording command before the supply time has passed from the start of the driving of the pump 53, the supply-time determining section 64*a* adds the time corresponding to the remaining time of the supply time when the humidifying maintenance has been discontinued, to the obtained supply time in the next humidifying maintenance, but the time corresponding to the remaining time may not be added to the obtained supply time.

Further, in the above-described embodiment, the supply-time determining section 64*a* calculates the supply time such that, the longer the length of time of the preceding uncapping state of the cap 40, which time is obtained by the capping history storage section 63, the longer the supply time is, but in addition to this, the supply-time determining section 64*a* may calculate the supply time such that, the longer a length of time from the establishment of the capping state to the start of the supply of the humid air, the longer the supply time is. This is because the drying of the ink in the ejection openings 14*a* continues also after the capping state is established (noted that a speed of the drying is slower than in the uncapping state).

Further, in the above-described embodiment, the supply-time determining section 64*a* makes the supply time longer where the humidity detected by the humidity sensor 58 for detecting the humidity of the ambient air of the caps 40 is equal to or lower than the predetermined value, but the supply time may be determined without considering the humidity of the ambient air of the caps 40. Further, the printer 1 may be configured such that the printer 1 includes a temperature sensor for detecting a temperature of the ambient air of the caps 40, and the supply-time determining section 64*a* determines the supply time such that the supply time is made longer where a temperature detected by the temperature sensor is equal to or higher than a predetermined value.

Further, in the above-described embodiment, when the predetermined time has passed from the completion of the humidifying maintenance, the ejection space S1 is humidified again, but such a humidification may not be performed.

In addition, in the above-described embodiment, the supply time for supplying the humid air into the ejection space S1 is determined such that the density or the viscosity of the ink in the ejection openings 14*a* is equal to or lower than the proper value, but where the humidity in the ejection space S1 is higher than the environmental humidity, the density or the viscosity of the ink in the ejection openings 14*a* may be equal to or higher than the proper value. In such a configuration, it is required to discharge ink having a density or a viscosity that has become equal to or higher than the proper value by the flushing, but the supply of the humid air makes it possible to reduce an amount of the ink to be discharged.

Further, in the above-described embodiment, the longer the elapsed time elapsed from the last ejection of the ink from the ejection openings) 14*a*, the longer the supply time is determined to be, but the supply time may be determined without considering the elapsed time.

Further, in the above-described embodiment, when the recording command has been received before the predetermined time shorter than the obtained supply time has passed from the start of the driving of the pump 53, the humidifying maintenance is discontinued, and the flushing of the ink is performed from the ejection openings 14*a*, but the flushing may not be performed. Further, this printer 1 may be configured such that the flushing is performed each time when the humidifying maintenance is discontinued.

Further, in the above-described embodiment, the humid air is reused by the circulation in the humidifying maintenance but may be discharged to the outside of the ejection space S1 without the circulation of the humid air.

Further, the projecting portion 41*a* is not limited to be movable as in the above-described embodiment. For example, the printer 1 may be configured such that the projecting portions are fixed to the head holder so as not to be movable, and positions of the distal ends of the respective projecting portions relative to the ejection face are constant. In this case, the positions of the distal ends of the respective projecting portions relative to the ejection face can be changed by raising and lowering the head holder or the support face of the conveyance belt, whereby the projecting portions can be selectively positioned at the contact position and the distant position.

Figure 11:
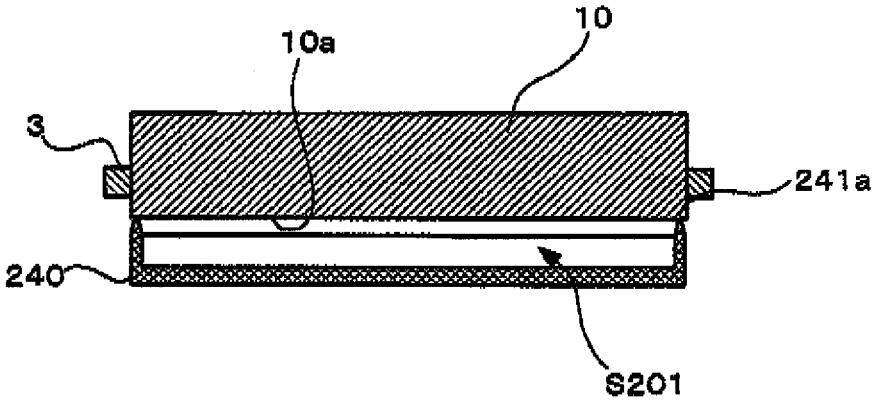
FIG. 11 is a view for explaining a modification of the embodiment of the present invention.

Further, as shown in FIG. 11, a cap 240 as one example of a cap member may be formed independently of the head 10. In this case, the cap 240 is disposed at a position facing the ejection face 10*a* by a cap moving mechanism, not shown. The cap 240 can be selectively positioned at a contact position at which an end portion 241*a* (as one example of an opening end) of the cap 240 is held in contact with the ejection face 10*a* and a distant position at which the end portion 241*a* is distant from the ejection face 10*a* by raising or toweling at least one of the head 10 and the cap 240. When the cap 240 is located at the contact position, an ejection space S201 is sealed with the cap 240 (a capping state). When the cap 240 is located at the distant position, the ejection space S201 is not sealed (an uncapping state). Thus, it is possible to seal the ejection space S201 by a simple construction.

Further, in the above-described embodiment, the inlet opening and the outlet opening of the circulation channel are formed in the head holder, but the inlet opening and the outlet opening may be formed in the head, the head holder, or the cap. Where the inlet opening and the outlet opening are formed in the cap, the humidifying mechanism 50 may be provided near the caps (noted that, in FIG. 5, the humidifying mechanism 50 is provided near the heads 10).

Further, the pump 53 and the tank 54 are used as the humidifying mechanism in the above-described embodiment, but other components or mechanism may be used as long as the air in the circulation channel can be humidified. For example, the printer 1 may be configured such that the humidification is performed only by the tank 54 without providing the pump 53. Further, the humidification may be performed by further using a heating means such as a heater, by using an ultrasound humidifying means, or by disposing a wet porous material such as a wet sponge or a wet cloth in the circulation channel.

The present invention is applicable to any of a line printer and a serial printer. Further, the application of the present invention is not limited to the printer, and the present invention is also applicable to devices such as a facsimile machine and a copying machine. Further, the present invention is also applicable to a device configured to eject liquid other than the ink.

What is claimed is:

1. A liquid ejection apparatus, comprising:

a liquid-ejection head having an ejection face in which a plurality of ejection openings are formed, the liquid-ejection head being configured to eject liquid through the plurality of ejection openings to record an image on a recording medium;

a sealing mechanism configured to selectively establish (i) a sealing state in which the sealing mechanism seals an ejection space, in which the plurality of ejection openings are open, from an outside and (ii) an unsealing state in which the sealing mechanism does not seal the ejection space from the outside;

a humid-air supply mechanism configured to supply humid air into the ejection space when the sealing mechanism is in the sealing state;

a storage memory configured to store first information corresponding to a length of time of the unsealing state; and a controller configured to determine an amount of the humid air to be supplied into the ejection space by the humid-air supply mechanism when the sealing mechanism is in a current sealing state based on a length of time of an unsealing state just before the current sealing state and configured to control the humid air supply mechanism to supply the determined amount of the humid air into the ejection space in the current sealing state, wherein the determined amount of the humid air to be supplied into the ejection space increases when the length of time of the unsealing state increases.

2. The liquid ejection apparatus according to claim 1, wherein the controller is configured to control the humid-air supply mechanism such that, after a first predetermined period has passed from a stop of the supply of the humid air into the ejection space in the current sealing state when the sealing mechanism is in the sealing state, the supply of the humid air into the ejection space is restarted.

3. The liquid ejection apparatus according to claim 1, wherein the controller is configured to control the humid-air supply mechanism such that a density or a viscosity of the liquid in the plurality of ejection openings is made equal to or lower than a proper value by the supply of the humid air into the ejection space.

4. The liquid ejection apparatus according to claim 1, wherein the controller is configured to further control the liquid-ejection head, and wherein, where the supply of the humid air into the ejection space by the humid-air supply mechanism is stopped to start the image recording before a second predetermined period has passed from a start of the supply of the humid air into the ejection space, the controller is configured to control the liquid-ejection head to eject a liquid droplet not contributing to the image recording from the plurality of ejection openings and then eject a liquid droplet contributing to the image recording from the plurality of ejection openings.

5. The liquid ejection apparatus according to claim 1, wherein the scaling mechanism includes a cap member having a recessed portion formed therein, and wherein an opening end of the cap member contacts the ejection face to cause the sealing mechanism to establish the sealing state.

6. The liquid ejection apparatus according to claim 1, wherein the first information comprises a first time at which the unsealing state is started and a second time at which the unsealing state is finished.

7. The liquid ejection apparatus according to claim 1, wherein the controller is configured to control the humid-air supply mechanism such that a humid-air supply period which is a length of time during which the humid air is supplied from the humid-air supply mechanism into the ejection space when the sealing mechanism is in the current sealing state, increases when the length of time of the unsealing state just before the current sealing state increases.

8. The liquid ejection apparatus according to claim 7, wherein the controller is configured to determine the humid-air supply period in the current sealing state, and wherein, where the supply of the humid air has been stopped before the humid-air supply period in the current sealing state has not passed from a start of the supply of the humid air, the controller adds a time corresponding to a remaining time of the humid-air supply period in the current sealing state to a humid-air supply period in a next sealing state.

9. The liquid ejection apparatus according to claim 7, further comprising a humidity sensor configured to detect a humidity of an ambient air around the sealing mechanism, wherein the controller is configured to determine the humid-air supply period on the basis of a result of the detection of the humidity sensor.

10. The liquid ejection apparatus according to claim 7, wherein the controller is configured to control the humid-air supply mechanism such that the humid-air supply period increases with a longer time elapsed from the last ejection of a liquid droplet from one of the plurality of ejection openings before the current sealing state is started.

11. A non-transitory storage medium storing computer-readable instructions that, when executed by a liquid ejection apparatus comprising:

a liquid-ejection head having an ejection face in which a plurality of ejection openings are formed, the liquid-ejection head being configured to eject liquid through the plurality of ejection openings to record an image on a recording medium;

a sealing mechanism configured to selectively establish (i) a sealing state in which the sealing mechanism seals an ejection space in which the plurality of ejection openings are open, from an outside and (ii) an unsealing state in which the sealing mechanism does not seal the ejection space from the outside;

a humid-air supply mechanism configured to supply humid air into the ejection space; and a storage memory configured to store first information corresponding to a length of time of the unsealing state, instruct the liquid ejection apparatus to perform a process comprising:

determining an amount of the humid air to be supplied into the ejection space by the humid-air supply mechanism when the sealing mechanism is in a current sealing state based on a length of time of the unsealing state just before the current sealing state; and controlling the humid air supply mechanism to supply the determined amount of the humid air into the ejection space in the current sealing state, wherein the determined amount of the humid air to be supplied into the ejection space increases when the length of time of the unsealing state increases.

* * * * *